US005653849A

United States Patent [19]

Venner

[11] Patent Number: 5,653,849

[45] Date of Patent: Aug. 5, 1997

[54] DEVICE FOR APPLYING A LABEL TO A BOTTLE OR A SIMILAR OBJECT

[75] Inventor: Marinus Theodorus Maria Venner, Deurne, Netherlands

[73] Assignee: Intersleeve B.V., Deurne, Netherlands

[21] Appl. No.: 535,401

[22] Filed: Sep. 28, 1995

[30] Foreign Application Priority Data

Sep. 30, 1994 [NL] Netherlands ..... 9401603

[51] Int. Cl.[6] ..... B65C 9/00

[52] U.S. Cl. ..... 156/556; 156/446; 156/449; 156/DIG. 13

[58] Field of Search ..... 156/556, 215, 156/446, 448, 449, 458, DIG. 13, DIG. 26

[56] References Cited

U.S. PATENT DOCUMENTS

| | | | |
|---|---|---|---|
| 3,159,521 | 12/1964 | Peachmann . | |
| 3,247,044 | 4/1966 | Peachmann . | |
| 4,323,416 | 4/1982 | Malthouse et al. . | |
| 4,448,629 | 5/1984 | Malthouse et al. . | |
| 4,526,645 | 7/1985 | Malthouse et al. . | |
| 4,544,431 | 10/1985 | King | 156/449 X |
| 4,714,515 | 12/1987 | Hoffman . | |
| 4,923,557 | 5/1990 | Dickey | 156/215 X |
| 4,931,122 | 6/1990 | Mitchell | 156/449 X |
| 5,082,520 | 1/1992 | West et al. | 156/458 X |

FOREIGN PATENT DOCUMENTS

| | | | |
|---|---|---|---|
| 0078076 | 4/1983 | European Pat. Off. . | |
| 1924131 | 11/1970 | Germany | 156/449 |

*Primary Examiner*—James Engel
*Attorney, Agent, or Firm*—Foley & Lardner

[57] ABSTRACT

A device for applying a label to a bottle or similar cylindrical object by rotating the same has a supply conveyor for moving the objects to at least one rotatable screw arranged horizontally over the supply conveyor for spacing and moving the objects at uniform speeds. A rotatable vacuum drum is positioned next to the supply conveyor, which drum is adapted to carry and apply labels to the objects. Conveyors are provided at both sides of the object adjacent and opposite the vacuum drum for rotating the objects before and during labelling. The downstream end of the screw is positioned at a predetermined distance from a plane perpendicular to the axis of the screw and the plane extends through the axis of the vacuum drum. The downstream end of the screw also extends into at least one of the conveyors. The conveyor situated adjacent the vacuum drum is coupled to the drum and extends and moves against the linear direction of movement of the objects.

11 Claims, 2 Drawing Sheets

DEVICE FOR APPLYING A LABEL TO A BOTTLE OR A SIMILAR OBJECT

BACKGROUND

The present invention relates to a device for applying a label to a bottle or a similar object having a cylindrical portion, by rotating the object. U.S. Pat. No. 4,931,122, for example, discloses a bottle labeling device having a first supply conveyor for supplying objects thereon in line to at least one horizontally extending rotatable screw arranged above the supply conveyor and situated laterally next to the objects, in such a way that an object can be lead at spaced intervals at the desired distance from each other. A vacuum drum rotatable around a substantially vertical axis carries a label to be applied onto an object. Above the supply conveyor, at least one conveyor belt is present for rotating the object before and during application of the label thereon.

In this known device the screw, which leads and spaces the objects, extends along the vacuum drum and opposite thereof. This is also the case with the belt that rotates the objects. This conveyor belt is situated at the same side as the vacuum drum and opposite the screw.

Thus, conveyor belt presses the objects against the screw when they are brought into rotation. Due to that, friction will be generated between the objects and the screw, as a consequence of which the rotational velocity of the object can vary slightly. This can result in an inaccurate application of the label onto the object.

Due to the fact that the label supplied by the vacuum drum and an object move in the same direction, rotation of the object will be counteracted by the label. The label will always have to be under a small tension in order to be able to apply it tightly onto the object.

SUMMARY

The object of the invention is to remove these difficulties by positioning the downstream end of the screw at predetermined distance from the plane extending through the axis of the vacuum drum and perpendicular to the axis of the screw. The predetermined distance is at least equal to half the diameter. Two conveyor belts are present, one at each side of the supply conveyor, for moving and rotating the objects, with the conveyor belt on the same side of the vacuum drum being coupled to the vacuum drum and extending and moving against the linear direction of movement of the objects.

Owing to this arrangement, immediately before applying a label onto an object, the object rotated by conveyor belts at both sides thereof. Therefore, during labelling onto an object the rotational velocity of the object will be very even.

Further, with the device according to the present invention, the direction of peripheral velocity of an object is equal to, but opposed to, the velocity at which the label is transported. This means that the label on the vacuum drum transfer to the object better than with the known device.

In particular, the conveyor belt opposite the vacuum drum can be composed of two subsequent parts, in which, seen in the linear direction of movement of the objects, a primary belt part situated opposite the vacuum drum and downstream of the downstream end of the screw, and a secondary belt part positioned upstream of the downstream end of the screw and connecting to the primary belt situated opposite the vacuum drum.

Here, the primary belt situated opposite the vacuum drum together with the vacuum drum and the belt coupled with it, provide the proper rotational velocity of the objects, while the secondary belt preceding the primary belt imparts rotation to the objects. Thus, the velocity of movement of the secondary conveyor belt can be smaller than that of the subsequent belt primary opposite the vacuum drum.

In an embodiment of a device according to the invention, the downstream end of the screw can be situated opposite the conveyor belt coupled to the vacuum drum.

However, it is also possible for the screw to be situated at the same side of the supply conveyor as the vacuum drum and that, preceding the conveyor belt coupled to the vacuum drum, a transfer conveyor can be provided, with the downstream end of the screw positioned between the ends of the transfer conveyor belt.

U.S. Pat. No. 5,082,521 discloses a device in which a conveyor belt is coupled to the vacuum drum and a conveyor belt for rotating and moving the objects situated at the other side of the supply conveyor opposite the vacuum drum. The conveyor belt is preceded by a star wheel that serves for spacing the objects at the desired mutual distances.

The difficulty in the use of a star wheel is that the linear velocity of an object accommodated by it changes continuously as long as the object is in contact with the star wheel. The velocity at which the object contacts the belt connecting to it, will therefore not be accurately determined. Further, this belt will have to have a much higher velocity than an object released by the star wheel rotate the same. After the object has followed the belt across a certain distance, it will contact the conveyor belt coupled to the vacuum drum. Due to this arrangement, the velocity of the object will again change. Thus, the velocity of an object will change a number of times across the length of the conveyor belt connecting to the star wheel. This accelerates wear and imparts vibrations and extra noise.

BRIEF DESCRIPTION OF THE DRAWINGS

The invention is further explained by means of examples, illustrated in the drawing, in which.

DESCRIPTION OF THE DRAWINGS

Figure 1:
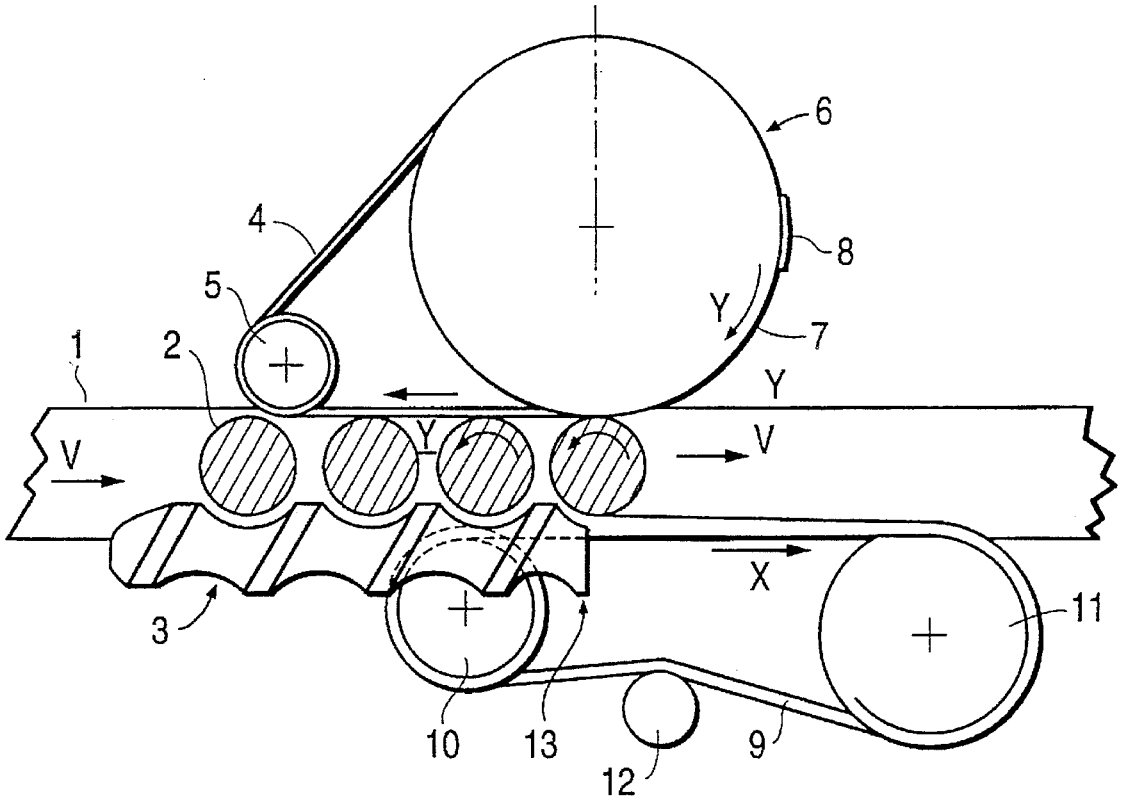
FIG. 1 shows diagrammatically a plan view of an embodiment of a device according to the invention.
Figure 2:
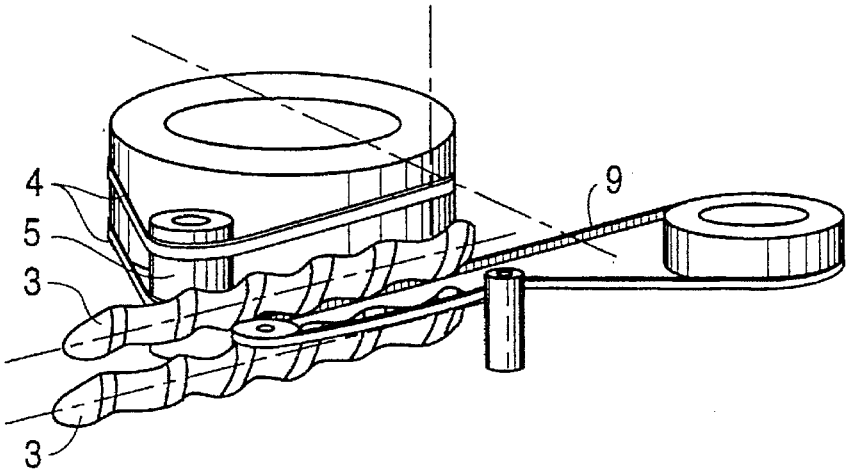
FIG. 2 shows diagrammatically a perspective view of some parts of the device of FIG. 1.

FIGS. 1 and 2 show a device according to the invention, comprising a supply conveyor 1 for supplying and moving objects 2 in the direction indicated by the arrow v. Since in many cases, the objects will be bottles, hereinafter we will speak of bottles for the sake of simplicity.

In general, the bottles 2 will stand against each other. To space them at the proper mutual distance, two superimposed screws 3, which are supported and synchronously driven by means not further indicated, are used. The bottles are accommodated in the threads of both screws and by rotation of the screws they are moved further in the direction of the arrow V, yet with an adjusted velocity.

Opposite the screws 3 there are two superimposed conveyor belts 4 running across a guide roller 5 and across the vacuum drum 6. The vacuum drum 6 is driven and the vacuum generated in the drum causes labels 8 on the punched wall 7 of the drum to be taken along, which labels are to be applied onto the bottles 2.

Opposite the conveyor belts 4 and between the screws 3 is a conveyor belt 9 running across the rollers 10 and 11, with one of them driven in such a way that the part of the belt 9 near the bottles 2 is moved in the direction of the arrow X. A roller 12 can serve for tensioning the belt 9. The roller 10 is situated before or behind the downstream end 13 of the screws 3.

The bottles 2 are caused to rotate by means of the belts 4 and 9. The rotational velocity can be such that the peripheral velocity Y of a bottle 2 equals the peripheral velocity of the vacuum drum 6. The peripheral velocity is indicated by Y. Owing to this configuration, when the beginning of the label 8 contacts a bottle 2, the label 8 will have the same velocity as the bottle. Thus, there will not be any displacement of the label in relation to the bottle.

In most cases, two small vertical adhesive layers are applied on a label, one at the beginning and one at the end of the label. When, however, a certain adhesion exists between a label and a bottle, applying these adhesive layers can be abandoned in that, as mentioned earlier, the label and the bottle can have the same velocity when they contact each other. The advantage of applying a label in this way is that it can be removed easily when the bottle must be re-usable.

It will be obvious, that instead of two screws 3, one could also employ one single screw, whereas then, two belts 9 can be applied. All this will depend on the size of the bottles, since they must be sufficiently stable during transport.

Figure 3:
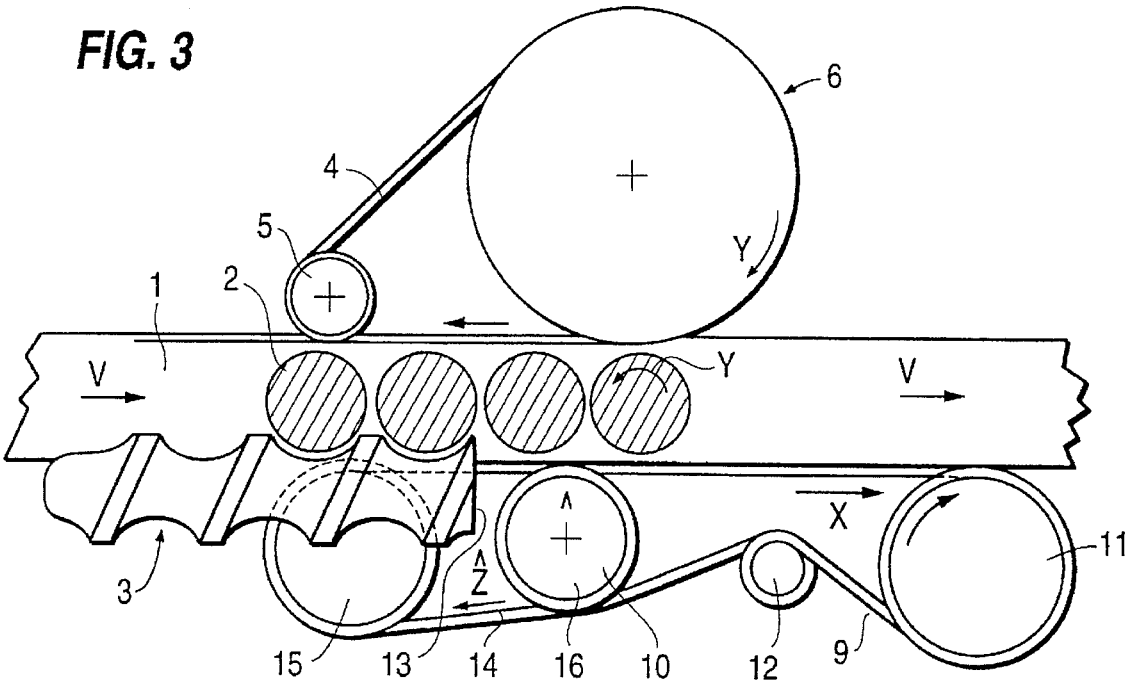
FIGS. 3 and 4 show diagrammatically plan views of two further embodiments of a device according to the invention.

The embodiment according to FIG. 3 largely corresponds to that according to the FIGS. 1 and 2, so that corresponding parts have been indicated by the same reference numbers. In this embodiment, the end 13 of the screws 3 is at a greater distance from the vacuum roller 6 and a secondary conveyor belt 14 extends at both sides of the downstream end 13 and runs across the rollers 15 and 16. The belt 14 moves in the direction of the arrow Z. The axis of rotation of the roller 16 can coincide with that of the roller 10, across which the belt 9 runs, so that there will not be any interruption in supporting the bottles.

Figure 4:
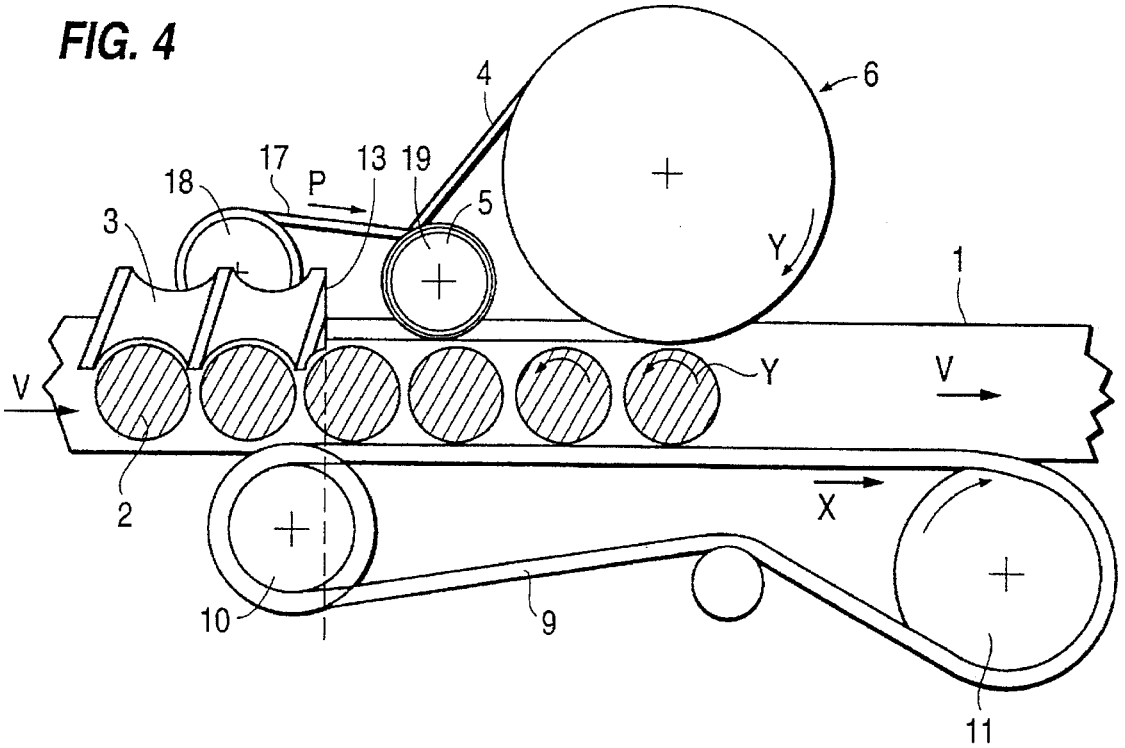

In the embodiment according to FIG. 4, corresponding parts have again been indicated by the same reference numbers as in the FIGS. 1–3. In this embodiment, the screw 3 is at the side of the supply conveyor 1 where the vacuum roller 6 is situated, and its downstream end 13 is situated before the beginning of the conveyor belts 4. In connection with that, a transfer conveyor 17 running across the rollers 18 and 19 has been provided for. The axis of rotation of the roller 19 coincides with that of the roller 5 of the conveyor belts 4 and the belt 17 moves in the direction of the arrow P.

It will be obvious, that only some possible embodiments of a device according to the invention have been illustrated in the drawing and described above and that many changes can be made without being beyond the inventive idea.

I claim:

1. A device for applying a label to a substantially cylindrical object comprising:

a supply conveyor for moving and supplying the cylindrical objects in a row;

at least one horizontally extending rotatable screw positioned substantially parallel to and above the supply conveyor;

a vacuum drum rotatable about a substantially vertical axis and adapted to carry labels to be applied to the cylindrical objects on the vacuum drum, the vacuum drum being positioned adjacent to the supply conveyor and spaced away from a downstream end of the screw, wherein the screw is adapted to space and move the cylindrical objects, and feed the cylindrical objects one at a time to the vacuum drum; and substantially opposing first and second conveyors for moving and rotating the objects sandwiched therebetween before and while the objects passes the vacuum drum, the first conveyor being at a substantially same general side as the vacuum drum and drivingly connected to the vacuum drum and extending upstream of the vacuum drum, the first conveyor moving in an opposite direction of the supply conveyor, and the second conveyor moving in the same direction as the supply conveyor;

wherein the downstream end of the screw is spaced by at least a half a diameter of the object from a plane that is perpendicular to an axis of the screw and that extends through an axis of the vacuum drum, and wherein the downstream end of the screw extends beyond an upstream end of at least one of the first and second conveyors so that the screw and at least one of the first and second conveyors engage the object before the object is released from the screw to impart rotation to the object while the screw moves the object; and further comprising a transfer conveyor positioned upstream of the first conveyor and drivingly connected to the first conveyor, wherein the downstream end of the screw is positioned between the ends of the transfer conveyor.

2. A labeling device according to claim 1, wherein the screw is positioned substantially on the same general side as the vacuum drum.

3. A device for applying a label to a substantially cylindrical object comprising:

a supply conveyor for moving and supplying the cylindrical objects in a row;

at least one horizontally extending rotatable screw positioned substantially parallel to and above the supply conveyor;

a vacuum drum rotatable about a substantially vertical axis and adapted to carry labels to be applied to the cylindrical objects on the vacuum drum, the vacuum drum being positioned adjacent to the supply conveyor and spaced away from a downstream end of the screw;

wherein the screw is adapted to space and move the cylindrical objects, and feed the cylindrical objects one at a time to the vacuum drum; and substantially opposing first and second conveyors for moving and rotating the objects sandwiched therebetween before and while the object passes the vacuum drum, the first conveyor being at a substantially same general side as the vacuum drum and drivingly connected to the vacuum drum and extending upstream of the vacuum drum, the first conveyor moving in an opposite direction of the supply conveyor, wherein the downstream end of the screw is spaced by at least a half a diameter of the object from a plane that is perpendicular to an axis of the screw and that extends through an axis of the vacuum drum, wherein the downstream end of the screw extends beyond an upstream end of at least one of the first and second conveyors so that the screw and at least one of the first and second conveyors engage the object before the object is released from the screw to impart rotation to the object while the screw moves the object; and wherein the downstream end of the screw extends beyond the upstream ends of both the first and second conveyors.

4. A labeling device according to claim 3, wherein the second conveyor moves in the same direction as the supply conveyor.

5. A labeling device according to claim 4, wherein the second conveyor, which is opposite first conveyor and the vacuum drum, comprises a primary conveyor and a secondary conveyor drivingly connected to the primary conveyor, wherein the primary conveyor is positioned downstream of the secondary conveyor and the downstream end of the screw is positioned within the ends of the secondary conveyor.

6. A labeling device according to claim 5, wherein the screw is positioned substantially on the same general side as the second conveyor.

7. A labeling device according to claim 4, wherein the first and second conveyors are adapted to sandwich the cylindrical object and rotate the same to a degree where a peripheral velocity thereof is equal to a peripheral velocity of the vacuum drum during labeling.

8. A labeling device according to claim 3, wherein the screw is positioned substantially on the same general side as the vacuum drum.

9. A labeling device according to claim 3, wherein the screw is positioned substantially on the same general side as the vacuum drum.

10. A device for applying a label to a substantially cylindrical object comprising:

a supply conveyor for moving and supplying the cylindrical objects in a row;

at least one horizontally extending rotatable screw positioned substantially parallel to and above the supply conveyor;

a vacuum drum rotatable about a substantially vertical axis and adapted to carry labels to be applied to the cylindrical objects on the vacuum drum, the vacuum drum being positioned adjacent to the supply conveyor and spaced away from a downstream end of the screw;

wherein the screw is adapted to space and move the cylindrical objects, and feed the cylindrical objects one at a time to the vacuum drum; and substantially opposing first and second conveyors for moving and rotating the objects sandwiched therebetween before and while the object passes the vacuum drum, the first conveyor being at a substantially same general side as the vacuum drum and drivingly connected to the vacuum drum and extending upstream of the vacuum drum, the first conveyor moving in an opposite direction of the supply conveyor, and the second conveyor moving in the same direction as the supply conveyor;

wherein the downstream end of the screw is spaced by at least a half a diameter of the object from a plane that is perpendicular to an axis of the screw and that extends through an axis of the vacuum drum;

wherein the downstream end of the screw extends beyond an upstream end of the first and second conveyors so that the screw and at least one of the first and second conveyors engage the object before the object is released from the screw to impart rotation to the object while the screw moves the object;

wherein the second conveyor, which is opposite first conveyor and the vacuum drum, comprises a primary conveyor and a secondary conveyor drivingly connected to the primary conveyor, wherein the primary conveyor is positioned downstream of the secondary conveyor and the downstream end of the screw is positioned within the ends of the secondary conveyor; and wherein the downstream end of the screw extends beyond the upstream ends of both the first and second conveyor.

11. A labeling device according to claim 10, wherein the downstream end of the screw extends beyond upstream ends of both the first and second conveyors.

* * * * *